US006523198B1

(12) United States Patent
Temple

(10) Patent No.: US 6,523,198 B1
(45) Date of Patent: Feb. 25, 2003

(54) MODULAR MEDICAL-BED MATTRESS WITH UNDERLYING BED PAN

(76) Inventor: Barbara E. Temple, 217 Nob Hill Dr., Elmsford, NY (US) 10523

( * ) Notice: Subject to any disclaimer, the term of this patent is extended or adjusted under 35 U.S.C. 154(b) by 0 days.

(21) Appl. No.: 09/989,573

(22) Filed: Nov. 23, 2001

(51) Int. Cl.[7] ..... A61G 7/02

(52) U.S. Cl. ..... 5/604; 5/695; 5/722; 5/497; 5/690; 5/727; 5/909; 5/421; 5/600; 5/618

(58) Field of Search ..... 5/604, 605, 695, 5/722, 727, 729, 690, 421, 600, 618, 909, 497

(56) References Cited

U.S. PATENT DOCUMENTS

| | | | | | |
|---|---|---|---|---|---|
| 1,040,795 | A | * | 10/1912 | Skeffington | 5/722 |
| 1,276,361 | A | * | 8/1918 | Hobert | 5/722 |
| 1,295,770 | A | * | 2/1919 | Lamont | 5/722 |
| 1,528,066 | A | * | 3/1925 | McEntire | 5/722 |
| 2,615,175 | A | * | 10/1952 | Corakas | 5/695 |
| 2,932,831 | A | * | 4/1960 | Keathley, Sr. et al. | 5/604 |
| 3,886,610 | A | * | 6/1975 | Shelden | 5/727 |
| 4,011,610 | A | * | 3/1977 | Parker, III | 5/695 |
| 4,051,566 | A | | 10/1977 | Esquivel | 5/727 |
| 4,706,313 | A | | 11/1987 | Murypy | 5/722 |
| 4,935,978 | A | | 6/1990 | Luchonok et al. | |
| 4,974,270 | A | * | 12/1990 | Kuhn | 5/695 |
| 5,327,599 | A | * | 7/1994 | Bradley, Jr. | 5/604 |
| 5,535,464 | A | * | 7/1996 | Salonica | 5/604 |
| 5,745,940 | A | | 5/1998 | Roberts et al. | 5/727 |
| D411,933 | S | | 7/1999 | Bernstein | D6/596 |
| 6,192,538 | B1 | | 2/2001 | Fogel | 5/727 |

* cited by examiner

*Primary Examiner*—Alexander Grosz
(74) *Attorney, Agent, or Firm*—Donald R. Schoonover

(57) ABSTRACT

A mattress system includes a mattress unit having a plurality of self-contained mattress modules supported on a frame unit that is accommodated on an electric bed unit. The mattress modules are interchangeable, removable and replaceable whereby a bed can be customized for the particular needs of a patient and can also be changed as required for patient care and comfort. Also included in the mattress system is a bedpan, located beneath the central mattress modules. The bedpan can be utilized by removing the center mattress module.

3 Claims, 3 Drawing Sheets

MODULAR MEDICAL-BED MATTRESS WITH UNDERLYING BED PAN

BACKGROUND OF THE INVENTION

1. Field of the Invention

The present invention relates to the general art of bedding, and to the particular field of therapeutic mattresses for medical beds.

2. Discussion of the Related Art

Bed-ridden patients often encounter problems, especially if the patient is bed-ridden for long periods. One common problem includes the development of pressure ulcers, localized areas of tissue necrosis that occur when soft tissue is pressed between bony prominence and external surface for an extended period of time. Skin is broken down due to friction, moisture, pressure, or shearing forces. Blood flow to underlying tissue is interrupted. Some mattresses and bed units can cause some part of a pressure-ulcer related problem. In such instances, an entire mattress may have to be replaced.

While some therapeutic mattresses relieve some of the pressure-ulcer related problems by preventing bedding from having undisturbed contact with a patient, these units do not completely solve the problem, and they can be heavy and expensive. The caregiver may have to periodically move the patient, but this may require a health care worker who is able to lift the patient. This may be difficult and awkward for the health care worker, and uncomfortable and inconvenient for the patient, and costly for the patient's loved ones.

Therefore, there is a need for a bed unit that can reduce the possibility of a patient developing and exacerbating bed sores on the areas of his or her body that contact the mattress or a covering on a mattress.

Many health care facilities suffer from a significant shortage of help, and help that is on duty is often rushed and harried. This help must place priorities on many tasks. For example, changing a mattress or bedding may have to wait until other tasks are completed. This procedure may make efficient use of health care worker time, but it may place a hardship on some patients.

Still further, if a patient soils his or her bed, the bed must be changed. Again, if a hospital is short staffed, a soiled bed may not be cleaned or replaced as quickly as needed. This is especially so if the entire mattress unit must be replaced. Replacing an entire mattress unit may take more than one worker thus requiring a patient to wait until multiple workers are available. This not only inconveniences the patient, it adds further work for the staff.

Simply making up beds in a health care facility can be a major undertaking. A short-staffed health care facility may not make or re-make beds as often as it would like due to a need to efficiently allocate staff resources. In some cases, the difficulty in changing a bed causes the staff to delay changing a bed for as long as possible. Thus, some beds may not be remade as often as they should be. An easily changed bed may encourage staff to change a bed more often. Often, a bed with a patient is made and re-made. Unmaking and then remaking a bed with a patient still in it is often difficult for both the patient and for the worker.

Therefore, there is a need for a bed unit that can be efficiently cared for. Still further, there is a need for a bed unit in which the bed can be unmade and then remade in an efficient manner and with the least amount of disturbance to the patient.

Still further, if a patient needs a bedpan, that patient must request the bedpan, be lifted to permit the bedpan to be placed in position, and then again request assistance to remove the bedpan and be lifted again to allow removal of the bedpan. The health care staff is thus required to accomplish several tasks each time a patient requires a bedpan. This problem is particularly severe if the patient is suffering from diarrhea. A bedpan may also be very uncomfortable to use, and may not be left in place. This requires many trips to the patient's bedside by the health care staff, who also risk back injuries during the repeated lifting of the patients. The staff also risks dropping patients on the floor if they must take them to the bathroom, or lift them into a potty chair, which may result in patient injuries.

Therefore, there is a need for a bed unit which can accommodate a bedpan in a manner that is comfortable for the patient and convenient and efficient for the health care staff.

Many patients require a periodic change in mattresses. Changing a bed, and especially a mattress, may require the services of several health care workers. Furthermore, changing a mattress may be inconvenient and uncomfortable for a patient.

Therefore, there is a need for a bed unit that permits efficient changing of a mattress and keeps a patient comfortable while the mattress is being changed.

Many mattresses become worn after prolonged use. Such mattresses must be replaced. However, the inventor has noticed that many mattresses do not become totally worn before they must be entirely replaced. That is, a mattress may become worn near a central area of the mattress but not become worn at the sides and ends of the mattress. However, present mattresses, while still relatively unworn in most areas must be entirely replaced because a small area of the mattress has become worn. This is expensive and time consuming.

Therefore, there is a need for a mattress that need not be entirely replaced if only a selected portion thereof is worn and the remaining parts of the mattress are not worn.

Not all patients are alike. Some are short, some are tall, some are heavy, some are light, and so forth. Even a single patient may have needs for different mattress characteristics for different sections of his or her body. However, presently available non-therapeutic hospital mattresses are generally quite uniform in design. Presently available mattresses cannot meet particular needs of an individual patient because the mattresses are generally uniformly produced and designed for the way patients are expected to be and not necessarily for the way a particular patient actually is. Therefore, there is a need for a mattress unit that can be customized for a particular patient's size, shape, and needs.

Some patients require application of heat or cold to portions of their body. Presently, a patient requiring a cold pack has such a pack attached to his body. This may be uncomfortable, especially if the patient is required to lie in a particular position for a long period of time and cannot move due to the pack attached to his body.

Therefore, there is a need for a mattress unit that can apply heat or cold to a patient in a comfortable and convenient manner.

Some hospital beds can move to allow a patient to sit up. Any mattress used on such beds must be able to accommodate such bed movement. In some cases, the mattress may be expensive and difficult to move.

Therefore, there is a need for a mattress that can be used in conjunction with a movable hospital bed that is easily moved and is inexpensive as compared to presently available mattresses.

Still further, the laundering of bedding used on hospital beds can be an expensive and difficult process because the sheets may be large and cumbersome. Therefore, there is a need for a mattress system in which bedding is easily and efficiently launderable.

PRINCIPAL OBJECTS AND ADVANTAGES OF THE INVENTION

It is a main object of the present invention to provide a mattress unit that is versatile.

It is another object of the present invention to provide a mattress unit that can be customized for a particular patient's needs.

It is another object of the present invention to provide a mattress unit that can reduce the possibility of a patient developing and exacerbating pressure ulcers on the areas of his or her body that contact the mattress or a covering on a mattress.

It is another object of the present invention to provide a mattress unit that can be efficiently cared for.

It is another object of the present invention to provide a mattress unit which can accommodate a bedpan in a manner that is comfortable and dignified for the patient and convenient and efficient for the health care staff.

It is another object of the present invention to provide a mattress unit that permits efficient changing of a mattress and keeps a patient comfortable while the mattress is being changed.

It is another object of the present invention to provide a mattress unit that need not be entirely replaced if only a selected portion thereof is worn and the remaining parts of the mattress are not worn.

It is another object of the present invention to provide a mattress unit that can apply heat or cold to a patient in a comfortable manner.

It is another object of the present invention to provide a mattress unit that can be used in conjunction with a movable hospital bed that is easily moved and inexpensive as compared to presently available mattresses.

It is another object of the present invention to provide a mattress unit in which any bedding associated with the mattress unit is easily launderable.

SUMMARY OF THE INVENTION

These and other objectives are achieved by a mattress system that contains a multiplicity of separate self-contained mattress modules which can be moved, removed and replaced as required to customize or service the mattress.

For example, if a patient needs more support in one area than in other areas, the module supporting the area needing more support can be replaced with a less worn module, and so forth. Further, if a patient needs a bedpan, a module can be removed to make accessible the bedpan, directly underneath, without removing the patient from the bed. Still further, mattress modules may be removed in an effort to either prevent pressure ulcers or to allow pressure ulcers to heal.

The mattress can thus be serviced in only the areas necessary and the entire mattress need not be replaced every time service is needed. If the patient soils a mattress, only the soiled portions of the mattress need be replaced making it much easier on both the patient and the health care staff or home caregiver.

If a patient develops a need for the application of heat or cold, a module of the mattress can be removed and a flat, rectangular hot or cold gel pack placed onto the mattress section, beneath its fitted sheet. As the gel pack heats or cools, a new gel pack can simply replace the previous pack thereby keeping the patient comfortable.

Still further, the mattress modules of the present invention are much smaller than presently available mattresses. Thus, any sheets used on the mattress modules will be small as compared to presently available sheets. Laundering small sheets would be easier than laundering the large sheets presently used.

DETAILED DESCRIPTION OF THE INVENTION

Figure 1:
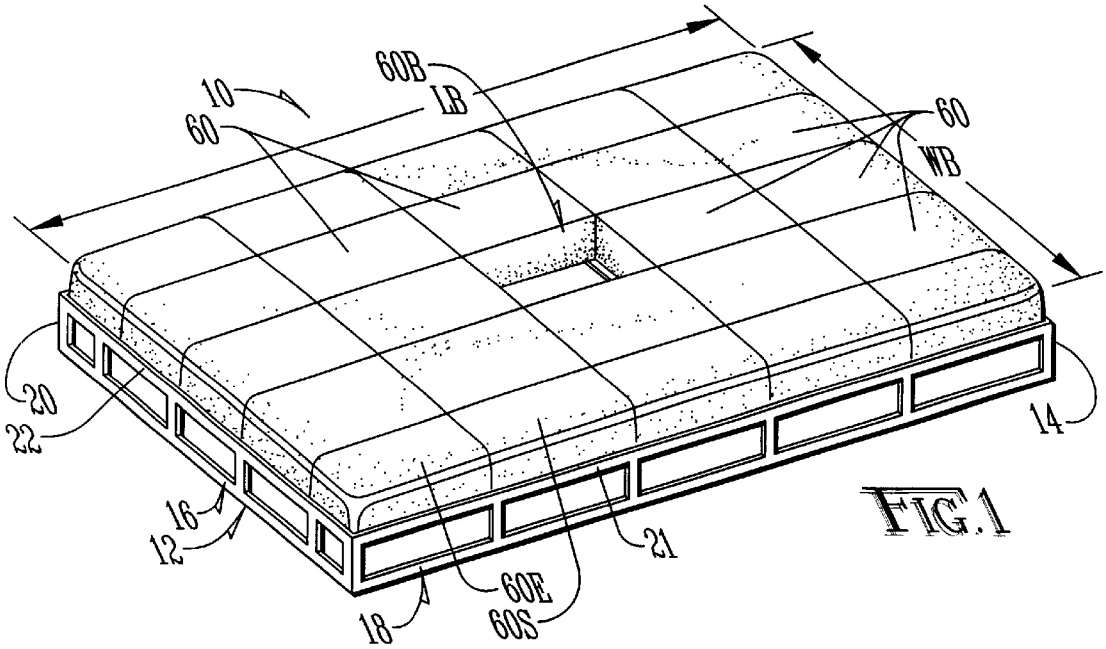
FIG. 1 is a perspective view of the modular medical-bed mattress of the present invention which includes a plurality of self-contained mattress modules, showing a frame unit and mattress modules with the center mattress module removed to permit bedpan access.

Other objects, features and advantages of the invention will become apparent from a consideration of the following detailed description and the accompanying drawings.

The mattress construction of the present invention permits a mattress to be customized and individualized for each patient and is easy to care for. In general, the mattress of the present invention is used in combination with an electric bed such as used in hospitals, and includes a multiplicity of individual, self-contained modules. The term self-contained will be understood from the following disclosure, but in general is intended to mean that each individual module includes all of the elements of a unit whereby a module can be removed from the overall mattress and replaced without disturbing any of the other modules in the mattress.

The mattress and bedpan system of the present invention is shown in FIGS. 1–4, and reference is now made to those figures. As shown, in FIG. 1, mattress 10 is used in combination with an electric bed unit. Electric bed mattress frame unit includes a portion 12 having two ends 14 and 16, two sides 18 and 20, and the electric bed unit includes equipment usual to electric beds to elevate portions of the bed relative to other portions of the bed. This equipment is not shown here since it is usual to such bed units.

Electric bed and mattress frame unit portion 12 includes a side guard, such as side guard 21, on each of the two sides 18 and 20, of electric bed mattress frame unit portion 12, an end guard, such as end guard 22, on each of the two ends 14 and 16 of electric bed mattress frame unit portion 12. Electric bed mattress frame unit portion 12 includes a length LB measured between the two ends 14 and 16 of electric bed mattress frame unit portion 12, and a width WB measured between the two sides 18 and 20 of electric bed mattress frame unit 12. Electric bed mattress frame unit portion 12 has a perimeter defined by the end guards and the side guards of electric bed and mattress frame unit portion 12.

Figure 3:
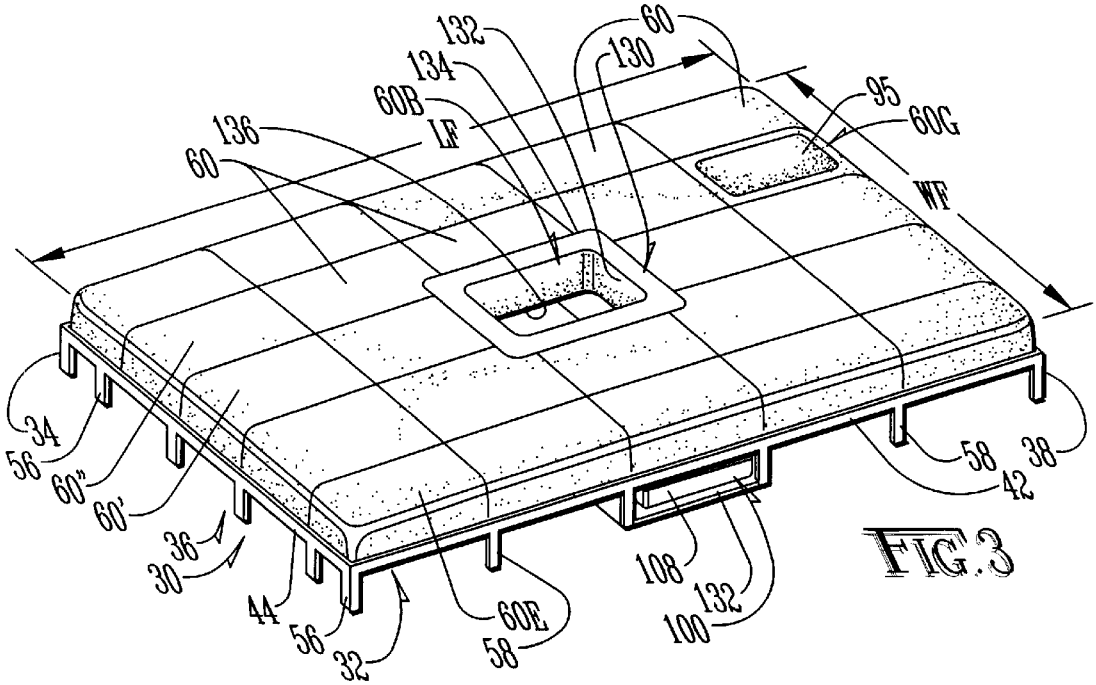
FIG. 3 is a perspective view of the mattress and frame units of the present invention showing the center mattress module removed, and showing the frame unit and bedpan support enclosure, and also showing the latex bedpan hole-accommodating stain shield in place.

As best shown in FIG. 3, the mattress system of the present invention also includes a frame unit 30 which includes two sides 32 and 34 and two ends 36 and 38 connected to sides 32 and 34. Frame unit 30 has a width dimension WF measured between the two sides 32 and 34 of frame unit 30, with width dimension WF of frame unit 30 being slightly less than width WB of electric bed unit portion 12. Frame unit 30 further includes a length dimension LF measured between the two ends 36 and 38 of frame unit 30, with length dimension LF of frame unit 30 being slightly less than the length LB of electric bed unit portion 12. The purpose of this relative dimensioning of frame unit 30 with respect to electric bed mattress frame unit portion 12 will be understood from the following disclosure.

Figure 2:
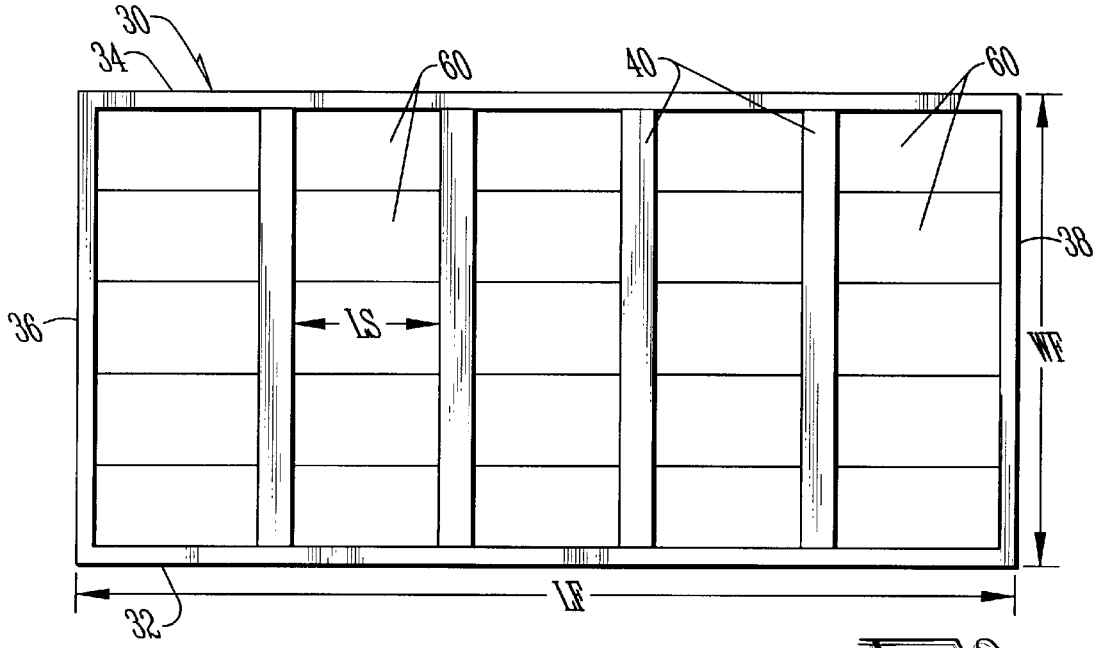
FIG. 2 is a bottom view of the frame and mattress modules of the mattress unit of the mattress and bedpan system of the present invention, shown without a bedpan support enclosure.

As can be seen in FIG. 2, frame unit 30 further includes a plurality of transverse slats, such as transverse slat 40, extending along width dimension WF of frame unit 30 from side 32 to side 34 of frame unit 30. Each of the plurality of transverse slats is spaced from an adjacent transverse slat by a lengthwise spacing LS measured along length dimension LF of the frame unit. Frame unit 30 further includes a vertical side lip 42 on each side 32 and 34 of the frame unit, a vertical end lip 44 on each end 36 and 38 of the frame unit, a horizontal side lip 46 on each side 32 and 34 of the frame unit, and a horizontal end lip 48 on each end of the frame unit. A plurality of hinges, such as hinges 50 and 52 are located on each side 32 and 34 of frame unit 30. Frame unit 30 further includes a plurality of legs, such as leg 56 and leg 58 supported by the electric bed mattress frame unit 12 at spaced-apart locations.

Width dimension WF of frame unit 30 is slightly less than width WB of electric bed mattress frame unit portion 12 and sized with respect to width WB of electric bed mattress frame unit portion 12 and length dimension LF of frame unit 30 is slightly less than length LB of electric bed mattress frame unit portion 12 to be sized with respect to length dimension LB of electric bed mattress frame unit portion 12 so legs 56 and 58 of frame unit 30 fit within the perimeter of electric bed mattress frame unit portion 12 with legs 56 and 58 of frame unit 30 being supported by the side and end guards of electric bed mattress frame unit portion 12 whereby frame unit 30 is supported on and accommodated by electric bed mattress frame unit 12.

Figure 5:
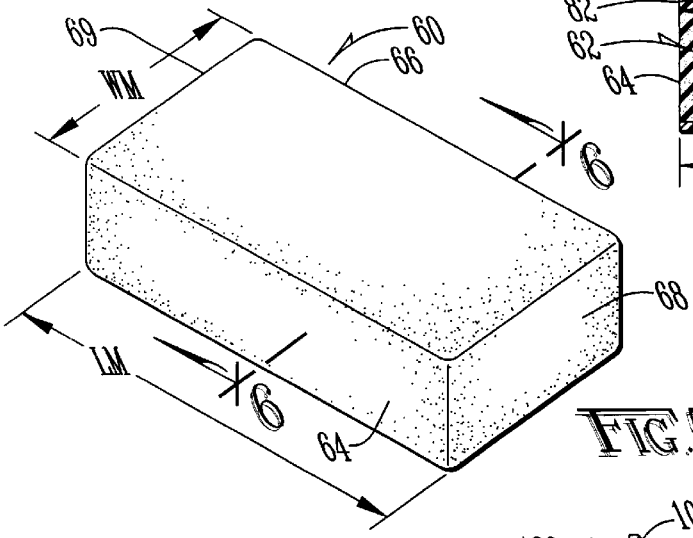
FIG. 5 is a perspective view of a mattress module of the mattress system of the present invention.
Figure 6:
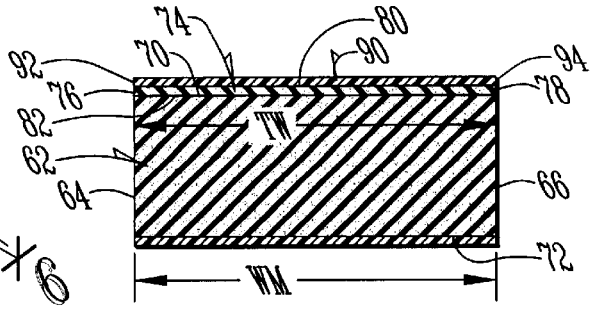
FIG. 6 is a cross-sectional view taken along line 6—6 of FIG. 5 showing the self-contained nature of the mattress module.

As shown in FIGS. 1 and 3, mattress unit 10 includes a plurality of mattress modules 60. Each mattress module 60 is self-contained, that is, each mattress module 60 is an entity unto itself and can be moved, removed, and/or replaced in the overall mattress unit 10 without requiring any modification of adjacent mattress modules 60. That is, as will be understood from the teaching of the present disclosure, one mattress module, such as mattress module 60' can be removed and/or replaced without any modification of an adjacent mattress module 60". Mattress modules 60' and 60" are also interchangeable. The self-contained nature of the mattress modules will be further appreciated from the following description. As shown in FIGS. 5 and 6, each self-contained mattress module 60 includes a base section 62 having two sides 64 and 66, two ends 68 and 69 connected to sides 62 and 64 of base section 62 of each mattress module 60. Each mattress module 60 further includes a width dimension WM measured between two sides 64 and 66 of each mattress module 60 of the plurality of mattress modules 60. Each mattress module 60 further includes a length dimension LM measured between the two ends 68 and 69 of each mattress module 60. Length dimension LM of each mattress module 60 is greater than the lengthwise spacing LS between adjacent transverse slats 40 whereby a mattress module 60 resting on two adjacent transverse slats 40 of frame unit 30 will be supported on and by the adjacent transverse slats 40.

Base section 62 of each mattress module 60 is formed of foam material or other suitable material resting on a steel platform, so a mattress module 60 is, in effect, a "mini-mattress" which will support a patient in the manner of a mattress. In some cases, base section 62 may even contain springs.

Each mattress module 60 further includes a top surface 70 of base 62 and a bottom surface 72 of base 62, and a structure foam mattress topper 74 on each mattress module 60. Each mattress topper 74 includes two sides 76 and 78, two ends, each located to be co-incident with an associated one of the ends 68 or 70 of base section 62, a width dimension TW measured between the two sides 76 and 78 of each mattress topper 74, and a length dimension measured between the two ends of each mattress topper 74 which equals length dimension LM of the mattress module. As can be seen in FIG. 6, width dimension TW of each mattress topper 74 is essentially equal to the width dimension WM of base 62 of each mattress module 60. Each mattress topper 74 further includes a top face 80 and a bottom face 82 which rests on top surface 70 of a mattress module 60 associated therewith. The perimeters of the mattress topper 74 and the base of each associated mattress module 60 are thus co-incident.

Each mattress module 60 further includes a plastic cover 90 which covers top face 80 of the mattress topper 74 on each mattress module 60. Each cover 90 includes two sides 92 and 94 and two ends which are co-incident with ends 68 and 70 of the base 62 associated therewith. A width dimension of each plastic cover is measured between the two sides 92 and 94 of each plastic cover 90 and is essentially equal to width dimension WM of the base section 62 associated therewith. A length dimension of each plastic cover 90 is measured between the two ends of each plastic cover 90 and is essentially equal to the length dimension LM of the base section 62 associated therewith. The plastic cover 90 thus has dimensions which make it co-incident with the base section 62 and the mattress topper 74 associated therewith.

The various mattress modules 60 can be located and positioned on the frame unit 30 in any location or position that is necessary for patient care. The self-contained nature of the modules 60 permits them to be moved around to customize a bed unit for the particular needs of a specific patient. As can be understood, the gel pad 95 can be moved into any location that is most needed for a patient. The self-contained nature of the mattress modules 60 permits this movement and rearranging of the mattress modules 60.

Figure 4:
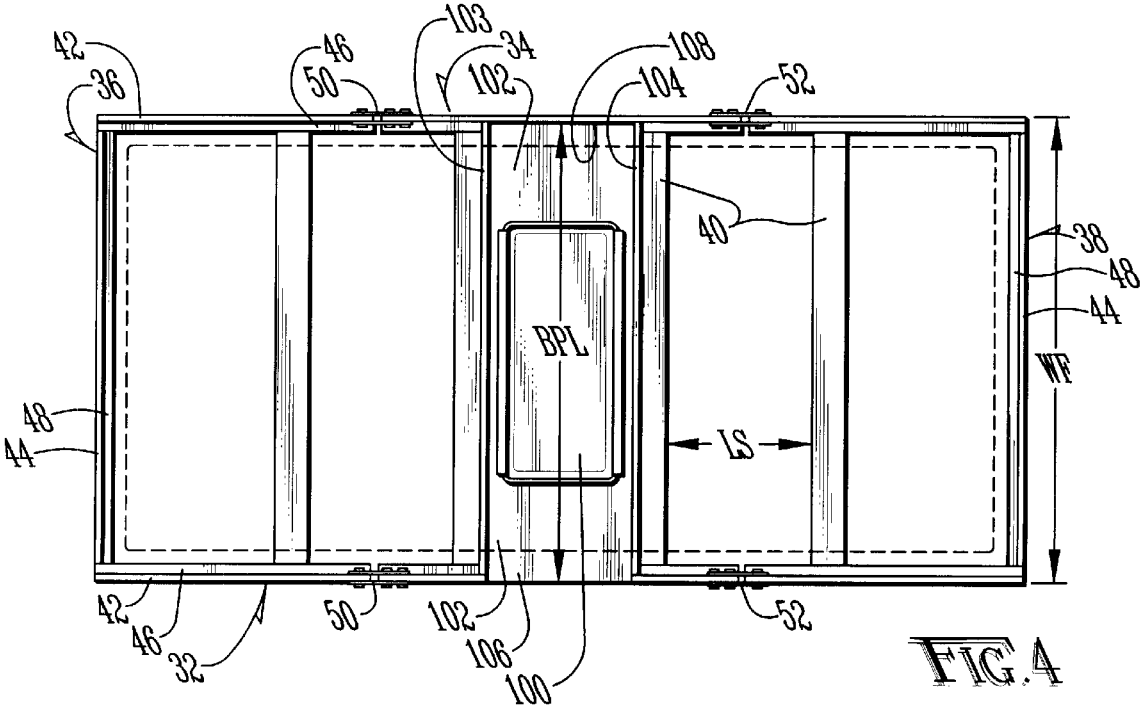
FIG. 4 is a top view of the frame unit of the present invention, shown without the mattress modules but shown with the bedpan in place on top of the bedpan support enclosure.
Figure 8:
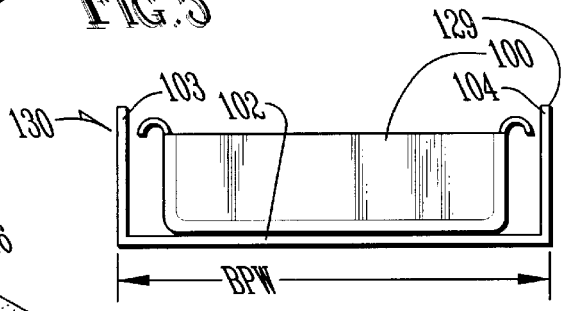
FIG. 8 is a side view of the support enclosure, for supporting a bedpan which is situated beneath the opening created when the center mattress module is removed and also beneath the modules adjacent thereto, across the width of the mattress. The bedpan is also shown, within the support enclosure.

Frame unit 30 includes a bedpan unit 100 which is shown FIGS. 3, 4, 8 and 9 to include a bedpan support enclosure 102 which is shown in FIGS. 3, 4, and 8 and which has two sides 103 and 104, two ends 106 and 108, and a length measured BPL between the two ends 106 and 108 of bedpan support enclosure 102 which is essentially equal to width dimension WF of bed frame unit 30, and a width dimension BPW measured between the two sides 103 and 104 of bedpan support enclosure 102 which is the same as the lengthwise spacing LS between two adjacent transverse slats 40 with each of the sides 103 and 104 of the bedpan support enclosure 102 attached to, and extending below the top of, the two central transverse slats 40 of frame unit 30 and with a height measured between the top 129 and bottom 130 edges which is less than the height of legs 56 and 58 of frame unit 30. Bedpan support enclosure 102 extends beneath the center mattress module and its adjacent sections when bedpan unit 100 is in place on frame unit 30, and beneath the mattress unit.

Figure 9:
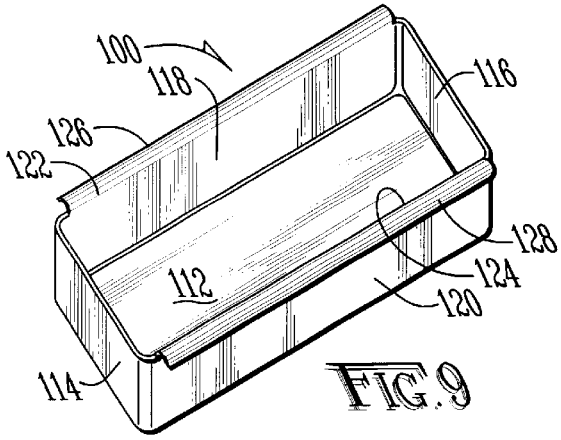
FIG. 9 is a perspective view of a bedpan used with the mattress system of the present invention.

A bedpan 100 is supported on bedpan support plate 132 beneath the opening 60B created when the center mattress module is removed, when the bedpan 100 is in place. The bedpan 100 will be located beneath the plane of the bottom surface of the mattress unit 10 on which a patient lies so the bedpan 100 will be out of the way and the patient need not elevate his or her hips to use the bedpan 100. This makes it more comfortable for a patient to have a bedpan in place ready for use at all times if necessary. Bedpan 100 is shown in FIGS. 4 and 9 and includes a base 112, two sides 114 and 116, two ends 118 and 120, an upper rim 122 and 124 on ends 118 and 120 respectively of bedpan 100. The upper rim 122, 124 has a curved lip 126 and 128. The curved lips 126, 128 are used to carry the bedpan 100 or to support it as necessary.

As shown in FIG. 3, mattress unit 10 further includes a bedpan hole-accommodating cover 134, a stain shield made of latex which extends into the hole left by the removed mattress module 60B in the center of the mattress. Bedpan hole-accommodating cover 134 has a hole 136 defined therethrough which is aligned with the hole left by the removed center mattress module 60B when bedpan hole-accommodating cover 134 is in place.

Figure 7:
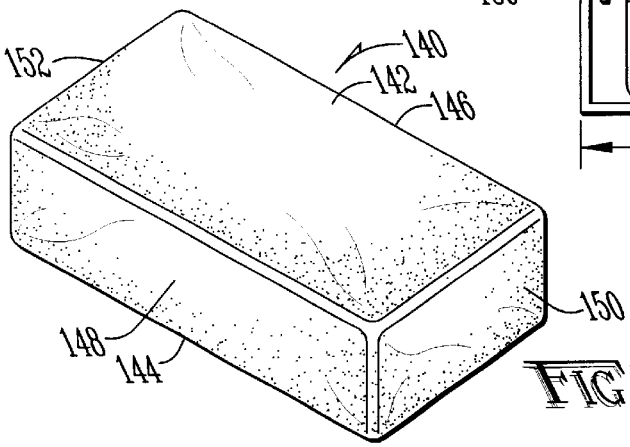
FIG. 7 is a perspective view of a fitted sheet used with the mattress module shown in FIG. 5.
Figure 10:
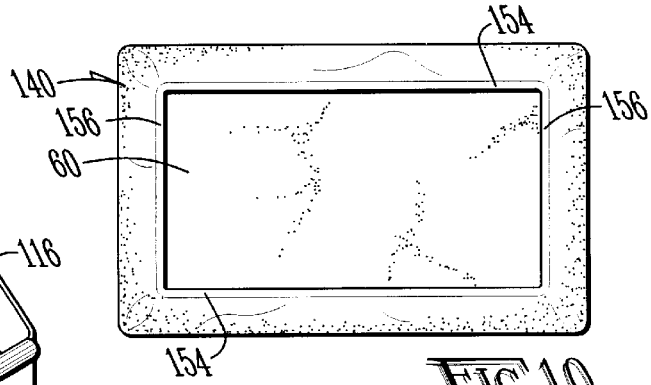
FIG. 10 is a bottom view of a mattress module with a fitted sheet, according to the present invention.

As shown in FIG. 7, mattress unit 10 further includes a fitted sheet 140 on each mattress module 60 of the plurality of mattress modules 60. Each fitted sheet 140 includes a top 142, a bottom 144, two sides 146 and 148, and two ends 150 and 152. Elastic 154 and 156.is located in the two sides 146 and 148 of fitted sheet 140 and in the two ends 150, 152 of fitted sheet 140. Fitted sheet 140 snugly fits around a mattress module 60 associated therewith when in place on the associated mattress module 60, so that the elastic is beneath mattress module 60, as shown in FIG. 10.

The form of the mattress system 10 shown in FIG. 1 includes twenty-five identical mattress modules.

It is understood that while certain forms of the present invention have been illustrated and described herein, it is not to be limited to the specific forms or arrangements of parts described and shown.

I claim:

1. A mattress and bed pan system comprising:

a) an electric bed mattress frame unit portion having
(1) two ends,
(2) two sides,
(3) a side guard on each of the two sides of said electric bed mattress frame unit portion,
(4) an end guard on each of the two ends of said electric bed mattress frame unit portion,
(5) a length measured between the two ends of said electric bed mattress frame unit portion,
(6) a width measured between the two sides of said electric bed mattress frame unit portion, and
(7) a perimeter defined by the end guards and the side guards of said electric bed mattress frame unit portion;

b) a modular-mattress frame unit which includes
(1) two sides,
(2) two ends connected to the sides,
(3) a width dimension measured between the two sides of said modular-mattress frame unit, the width dimension of said modular-mattress frame unit being slightly less than the width of said electric bed mattress frame unit portion,
(4) a length dimension measured between the two ends of said modular-mattress frame unit, the length dimension of said modular-mattress frame unit being slightly less than the length of said electric bed mattress frame unit portion,
(5) a plurality of transverse slats extending along the width dimension of said modular-mattress frame unit from a first side of the two sides to a second side of the two sides, each of the plurality of transverse slats being spaced from an adjacent transverse slat by a lengthwise spacing,
(6) a vertical side lip on each side of said modular-mattress frame unit,
(7) a vertical end lip on each end of said modular-mattress frame unit,
(8) a horizontal side lip on each side of said modular-mattress frame unit,
(9) a horizontal end lip on each end of said modular-mattress frame unit,
(10) a plurality of hinges on each side of said modular-mattress frame unit,
(11) a plurality of legs attached to said modular-mattress frame unit,
(12) the width dimension of said modular-mattress frame unit being slightly less than the width of said electric bed mattress frame and sized with respect to the width of said electric bed mattress frame unit portion and the length dimension of said modular-mattress frame unit being slightly less than the length of said electric bed mattress frame unit portion to be sized with respect to the length dimension of said electric bed mattress frame unit portion so the legs of said modular-mattress frame unit fit within the perimeter of said electric bed mattress frame unit portion with the legs of said modular-mattress frame unit being supported by the side and end guards of said electric bed mattress frame unit whereby said frame unit is supported on said electric bed mattress frame unit portion;

c) a plurality of mattress modules, each mattress module being self-contained and including (1) a base section having (A) two sides, (B) two ends connected to the sides of the base section of each mattress module, (C) a width dimension measured between the two sides of each mattress module of said plurality of mattress modules, (D) a length dimension measured between the two ends of each mattress module of said plurality of mattress modules, (E) the length dimension of each mattress module being greater than the lengthwise spacing between adjacent transverse slats of said modular-mattress frame unit whereby a mattress module resting on two adjacent transverse slats of said modular-mattress frame unit will be supported on and by the adjacent transverse slats, (F) the base section of each mattress module being formed of firm foam material on a steel platform, (G) a top surface of the base of each mattress module, and (H) a bottom surface of the base of each mattress module, (2) a structure foam mattress topper on each mattress module of said plurality of mattress modules, each mattress topper including (A) two sides, (B) two ends, (C) a width dimension measured between the two sides of each mattress topper, (D) a length dimension measured between the two ends of each mattress topper, (E) the length dimension of each mattress topper being essentially equal to the length dimension of the base of each mattress module, (F) the width dimension of each mattress topper being essentially equal to the width dimension of the base of each mattress module, (G) a top face of each mattress topper, and (H) a bottom face of each mattress topper resting on the top surface of a mattress module associated therewith, (3) a plastic cover on each mattress module and covering the top face of the mattress topper on each mattress module and including (A) two sides of each plastic cover, (B) two ends of each plastic cover, (C) a width dimension of each plastic cover measured between the two sides of each plastic cover that is substantially equal to the width dimension of each base section, and (D) a length dimension of each plastic cover measured between the two ends of each plastic cover that is substantially equal to the length dimension of each base section, (4) each mattress module of said plurality of mattress modules being separate from all other mattress modules of said plurality of mattress modules and being in abutting contact with adjacent mattress modules; and d) a bedpan unit which includes (1) a bedpan support enclosure which has (A) two sides of the bedpan support enclosure, (B) two ends of the bedpan support enclosure, (C) a length measured between the two ends of the bedpan support enclosure which is substantially equal to the width dimension of said modular-mattress frame unit, (D) a width dimension measured between the two sides of the bedpan support enclosure which is the same as the lengthwise spacing between two adjacent transverse slats with the top edges of said bedpan support enclosure being welded to the two central transverse slats of said modular-mattress frame unit and the entire support enclosure being beneath said transverse slats, and (E) a bedpan supported on the bedpan support enclosure beneath the opening created when the center mattress module is removed when the bedpan is in place, said bedpan including (i) a base of the bedpan, (ii) two sides of the bedpan, (iii) two ends of the bedpan, (iv) an upper rim on the ends of the bedpan, and (v) a curved lip on the upper rim of the bedpan, and (F) a separate and removable bedpan hole-accommodating cover, which acts as a stain shield, extending into the opening created when the center mattress module is removed, the bedpan holeaccommodating cover having a hole defined therethrough which is against the sides of the mattress modules adjacent to the removed center mattress module and above the top of the bedpan when in place; and (G) a fitted sheet on each mattress module of said plurality of mattress modules, each fitted sheet including (1) a top of the fitted sheet, (2) a bottom of the fitted sheet, (3) two sides of the fitted sheet, (4) two ends of the fitted sheet, (5) elastic underneath said fitted sheet and around the opening of said fitted sheet, and (6) said fitted sheet snugly fitting around a mattress module associated therewith when in place on the associated mattress module.

2. The mattress system as described in claim 1 further including twenty-five mattress modules.

3. In combination:

a) an electric bed mattress frame; and b) a mattress which includes (1) a modular mattress frame supported on said electric bed mattress frame, and (2) a multiplicity of self-contained identical mattress modules, each mattress module being separate from adjacent mattress modules and supported on the modular mattress frame of said mattress;

c) a bedpan setup which includes (1) a bedpan, and (2) a bedpan support enclosure, under a center mattress module;

d) gel packs which may be heated or cooled and which are relatively flat and dimensioned smaller than the dimensions of the top surface of a mattress module;

e) fitted sheets for each of the mattress modules; and f) a latex stain shield to be placed around the hole created when the center mattress module is removed in preparation for bedpan use.

* * * * *